United States Patent [19]

Parrott

[11] 4,172,561

[45] Oct. 30, 1979

[54] MINERAL LUMP BREAKER

[75] Inventor: George A. Parrott, Wakefield, England

[73] Assignee: Dresser Europe S.A., Brussels, Belgium

[21] Appl. No.: 904,592

[22] Filed: May 10, 1978

[30] Foreign Application Priority Data

May 26, 1977 [GB] United Kingdom ..... 22363/77

[51] Int. Cl.[2] ..... B02C 23/00

[52] U.S. Cl. ..... 241/186 R; 241/187; 241/280

[58] Field of Search ..... 241/239, 186 R, 189 A, 241/187, 189 R, 277, 280, 281

[56] References Cited

U.S. PATENT DOCUMENTS

| | | | |
|---|---|---|---|
| 2,654,986 | 10/1953 | Gold | 241/194 |
| 3,608,841 | 9/1971 | Wageneder et al. | 241/239 X |
| 3,806,048 | 4/1974 | Williams | 241/189 A |
| 3,857,519 | 12/1974 | Schafer et al. | 241/239 X |
| 4,125,227 | 11/1978 | Parrott et al. | 241/186 R |

*Primary Examiner*—Richard B. Lazarus

*Attorney, Agent, or Firm*—Larson, Taylor and Hinds

[57] ABSTRACT

A mineral lump breaker, for example for use in conjunction with a coal conveyor in a mine, comprises a breaker element and reaction means, for example in the form of a breaker plate or reaction discs. The breaker element and reaction means are carried by a framework straddling the conveyor and are spaced-apart so as to define between them a lump breaking gap. Material on the conveyor is moved into the gap where it is impacted by the breaker element against the reaction means. The reaction means is adjustable with respect to the breaker element periphery to vary the gap dimension.

20 Claims, 6 Drawing Figures

MINERAL LUMP BREAKER

This invention relates to a mineral lump breaker, for use in conjunction with a conveyor, to break down relatively large lumps of mineral to a size more readily handled by the associated conveyor or by a subsequent conveyor.

In coal mining operations for instance, an armoured face conveyor conventionally extends along a long-wall/shortwall coal face, which may be advancing or retreating, with at least one mining machine mounted on and guided by the sidewalls of the conveyor. In use, relatively large lumps of coal fall onto this conveyor during the cutting operation or by coal peeling from the coal face, due to strata movements. The face conveyor discharges at the main gate onto a stage loader of the scraper chain type which usually elevates coal onto a belt conveyor running along the main gate. Known coal breakers comprise a rotatable coal breaking drum and such breakers have worked in conjunction with stage loaders, either with coal fed into the breaker and thereafter fed onto the main gate conveyor, or with the breaker located above the stage loader. With the former arrangement it is usually necessary to split the stage loader and locate the breaker in between, which results in additional drive motors, sprockets etc. With the latter arrangement, the drum is rotatable about a generally horizontal axis and effects its breaking/crushing action between the drum periphery and both the deck plate and the tops of the sidewalls of the conveyor. Invariably, the sidewall tops become bent downwards and hence movement of the conveyor flight bars is obstructed and/or halted.

In U.S. patent application Ser. No. 817,212 filed July 20, 1977 now U.S. Pat. No. 4,125,227, there is disclosed breaking or crushing apparatus for conveyed material, comprising a frame defining a path for conveyed material and a rotary breaking or crushing element drivably carried by said frame, the latter being provided with non-driven reaction means against which material may be impacted and which is spaced from an adjacent periphery of the rotary element, the arrangement of the rotary element and the reaction means being such that, in use of the apparatus, material on the path passing between the rotary element and the reaction means is broken or crushed against the reaction means by the rotary element as the latter rotates. In one arrangement of that apparatus the rotary element is movably mounted on the frame and means are provided for adjusting the spacing of the rotary element from the reaction means. As the rotary element can be bulky and as it will generally be mounted, along with its drive, in a casing to form a relatively massive arm assembly which is movably mounted on the frame by a pivot arrangement, practical difficulties can arise in providing a suitable means for adjusting the angular position of the arm assembly about its pivot and, thereby, the spacing of the rotary element from the reaction means.

According to the present invention, a mineral lump breaker for use in conjunction with a conveyor, comprises a framework, a breaker element carried by the framework and rotatable about an upright or substantially upright axis (as defined below), the reaction means, against which material may be impacted and which is carried by the framework at a location spaced from the breaker element periphery to define a lump breaking gap, the reaction means being adjustable with respect to the breaker element periphery to vary the gap dimension.

By "upright or substantially upright" is meant that the axis should be as near vertical as floor conditions permit, but if the mineral lump breaker is located in a mine roadway for instance, the latter may have an uphill or downhill gradient, in order to follow the mineral seam being extracted.

Because the reaction means will generally be considerably less bulky than the breaker element and its associated drive and casing, the practical difficulties referred to above can be overcome.

The reaction means may comprise a breaker plate or, alternatively, it can take the form of an assembly of reaction discs rotatably mounted about an upright or substantially upright (as defined above) common axis. The reaction means in one arrangement is hingedly mounted on the framework about an axis parallel to the axis of rotatation of the breaker element. Preferably, the hinge means by which the reaction means is mounted on the framework can be disposed to be at or outside a sidewall of the conveyor when the breaker is in use, the reaction means being so mounted that a portion of the breaker plate may be displaced over the conveyor to an extent determined by the lump breaking gap required.

Power means may be provided for effecting any adjustment of the reaction means with respect to the breaker element periphery. In one construction, the power means comprises a hydraulic piston and cylinder unit mounted in the framework and operable on the reaction means via a lever pinned to the framework. The lever can be arranged to act on the reaction means via a roller. In one possible arrangement the hydraulic circuit associated with the hydraulic piston and cylinder unit preferably includes a relief valve to release the reaction means to open to the maximum extent the gap between the breaker element periphery and the reaction means, should material be encountered that the breaker is not capable of breaking.

In the case where the gearbox is associated with a fluid coupling and both are mounted in a common casing secured to the said framework, the latter can be recessed so that (when the lump breaker is positioned for use with a conveyor) by releasing the securement of the gearbox and fluid coupling casing from the framework, the casing, together with the suspended breaker element, may be swung away from the conveyor.

For a better understanding of the invention and to show how the same may be carried into effect, reference will now be made, by way of example, to the accompanying drawings, in which.

Figure 1:
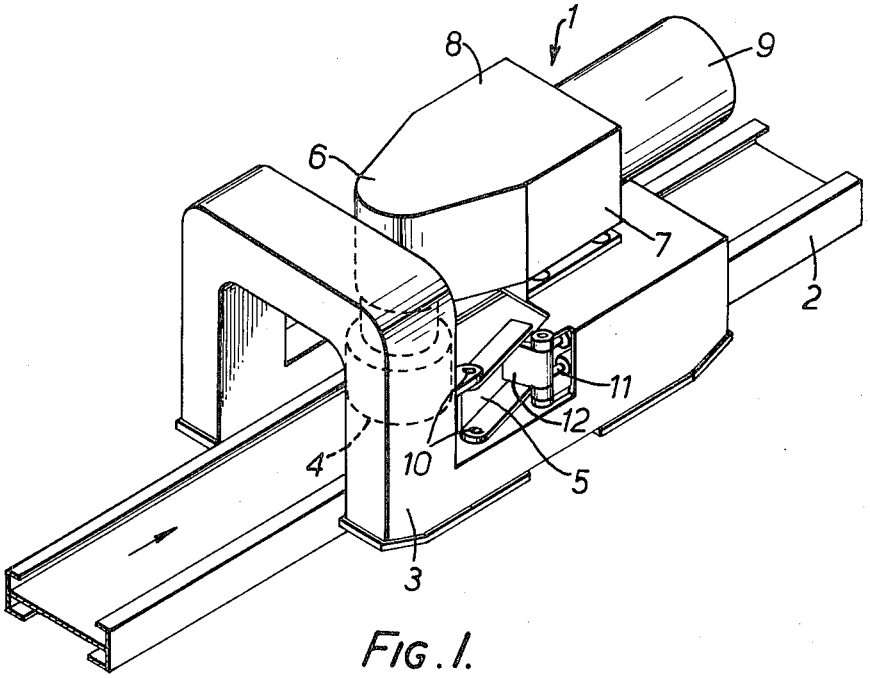
FIGS. 1 and 2 are respectively a general perspective view and a plan view of one form of coal lump breaker in accordance with the invention.
Figure 2:
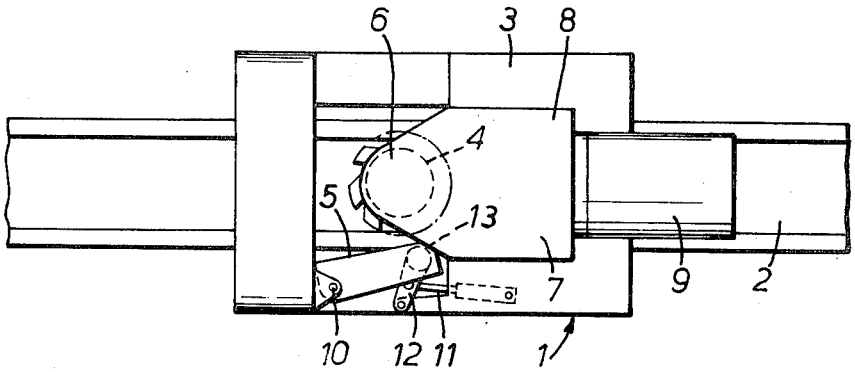

Referring to FIGS. 1 and 2, a lump breaker 1, used in conjunction with a conveyor 2, comprises essentially a framework 3, straddling the conveyor, and a breaker element in the form of a breaker drum 4 carried by the framework. The breaker drum is rotatable about an upright or substantially upright axis (as defined above).

A breaker plate 5, against which coal and rocks can be impacted, is carried by the framework 3 at a location spaced from the breaker drum periphery to define a lump breaking gap through which coal, rocks and other material on the conveyor is passed to be broken-up, or crushed, against the plate 5 by the rotating drum 4.

The drum is drivably suspended from a gearbox 6 with the lowermost end of the drum spaced from the conveyor by a distance governed by the size of the mineral not required to be broken down. Preferably, the gearbox is associated with a fluid coupling 7 and both are mounted in a common casing 8 secured, e.g. by four bolts, to the framework. To this casing may be attached a housing 9 for a motor, which is preferably electric.

As shown, the framework 3 is generally of inverted U-shape, of a span to bridge a standard width pan of the armoured conveyor, with the breaker plate 5 hinged at or towards a forward end of the framework and the motor, fluid coupling 7 and gearbox 6 carried by a rearward part of the framework 3.

The breaker plate is adjustable with respect to the breaker drum periphery to vary the dimension of the lump breaking gap and, for this purpose, the breaker plate is hinged (by hinges 10) at or towards one end thereof, about an axis parallel to the axis of rotation of the drum, the hinges 10 being located at or outside a sidewall of the conveyor, so that the portion of the breaker plate remote from the hinge may be displaced over the conveyor, to an extent determined by the gap required and hence the extent of breaking required. In the FIGS. 1 and 2 embodiment the hinging of the breaker plate is effected under the control of power means. Thus, a hydraulic piston and cylinder unit 11 may be mounted in the framework and operable on the breaker plate via a lever 12 pinned to the framework. The lever may act on the breaker plate via a roller 13.

The framework 3 may be staked in position or may be displaceable longitudinally of the conveyor 2. Preferably, the framework is recessed as shown in FIG. 1 so that by releasing three of the four bolts securing the gearbox and fluid coupling casing 8 to the framework, the casing, together with the suspended breaker drum 4, may be swung away from the conveyor, for drum replacement, re-picking etc.

Figure 3:
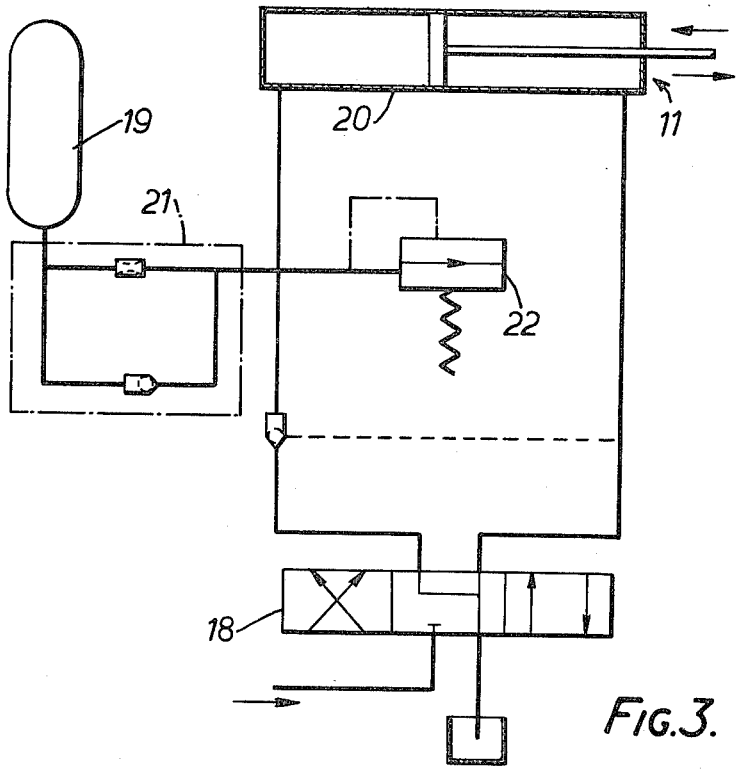
FIG. 3 shows hydraulic circuitry for operating a piston and cylinder unit incorporated in the breaker.

With a hydraulic piston and cylinder unit 11 employed to control displacement of the breaker plate 5, an associated hydraulic circuit is required, for example as shown in FIG. 3. As can be seen a manual control valve is provided for controlling the supply of hydraulic fluid to one or other of the end ports of the double-acting cylinders 20 of the unit 11 so as to open or close the lump breaking gap. An accumulator 19 serves as an overload device and is arranged such that in the event of an overload, caused for example by a lump of hard rock or a metal element being encountered that the breaker is not capable of breaking, hydraulic fluid passes into the accumulator to relieve the pressure in the cylinder 20, and thereby aloow the lump breaking gap to be widened. As shown, a valve arrangement 21 is provided to allow quick displacement of the drum breaker plate in the event of an overload but to ensure a slow return of the drum to its original position when the overload is removed. A safety relief valve 22 is connected between the supply connectections to the cylinder ports so that in the event of a predetermined overload which represents the maximum overload to which the circuit can safely be subjected, the valve opens to relieve the hydraulic pressure in the circuit.

Figure 4:
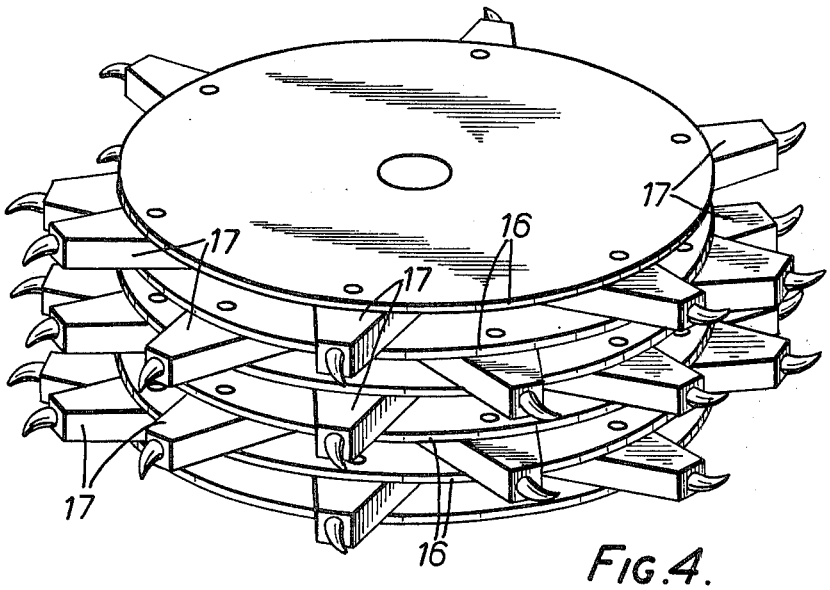
FIG. 4 is a perspective view of one constructional form of breaker drum.

It is advantageous if the lower edge of the breaker drum can be adjusted with respect to the conveyor to vary the mineral size which may be passed beneath the drum, and this may be achieved by the insertion or removal of packing elements between the casing of the gearbox and fluid coupling and the framework. Alternatively or in addition, the position of lower edge of the breaker drum may be adjusted by adding or replacing sections of the breaker drum. The drum may be provided with periphery static mineral breaking picks, or alternatively, picks may be provided on swinging hammers pivotable about axes parallel to that of drum rotation. Thus as shown in FIG. 4 the drum 4 may be built up from a plurality of axially spaced wafer plates 16, with common pivot pins passing through aligned holes in the plates, with the hammers 17 located between pairs of adjacent plates.

Figure 5:
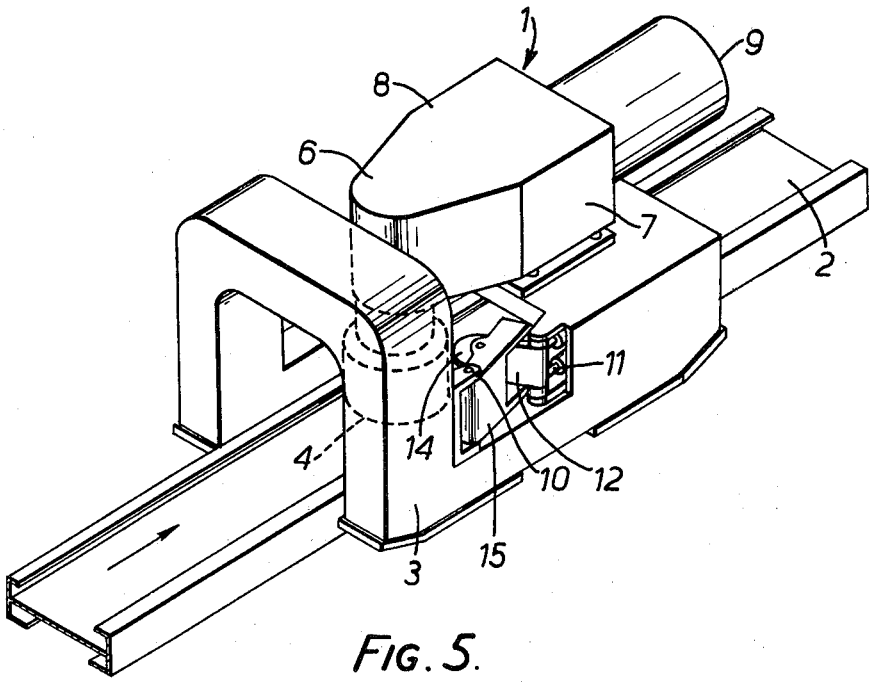
FIGS. 5 and 6 are corresponding views to FIGS. 1 and 2 of a modified lump breaker.
Figure 6:
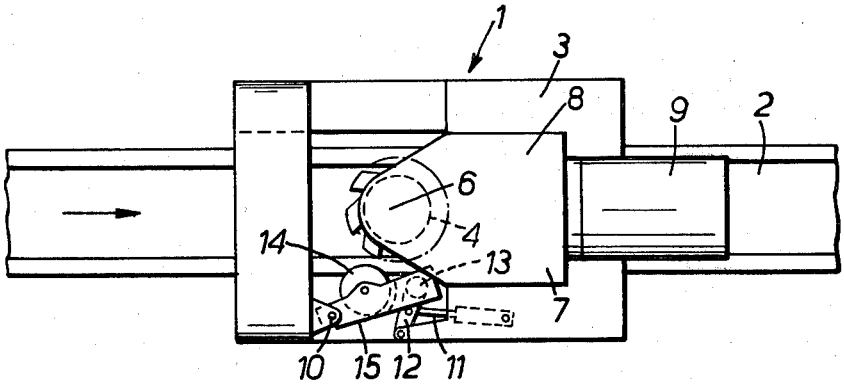

In the modification shown in FIGS. 5 and 6, the construction is essentially the same as that shown in FIGS. 1 and 2 and the same or corresponding parts have been denoted by the same reference numerals. However, instead of an adjustable breaker plate being used, there is employed an assembly of reaction discs 14 rotatably mounted about a common upright or substantially upright (as defined above) common axis in a supporting frame 15 itself hinged to the framework 3, and adjustable in position, in the same manner as the breaker plate in the FIGS. 1 and 2 embodiment.

I claim:

1. A mineral lump breaker for use in conjunction with a conveyor, comprising a framework, a breaker element carried by the framework and rotatable about an upright or substantially upright axis, and reaction means, against which material may be impacted and which is carried by the framework at a location spaced from the breaker element periphery to define a lump breaking gap, the reaction means being adjustable toward and away from the breaker element periphery to vary the gap dimension between the reaction means and the breaker element.

2. A breaker according to claim 1, wherein the breaker element is drivably suspended from a gearbox mounted on the said framework.

3. A breaker according to claim 2, wherein the gearbox is associated with a fluid coupling and both are mounted in a common casing secured to the said framework.

4. A breaker according to claim 1, wherein the reaction means is hingedly mounted on the said framework about an axis parallel to the axis of rotation of the breaker element.

5. A breaker according to claim 4, wherein the hinge means by which the reaction means is mounted on the said framework is disposed to be at or outside a sidewall of the conveyor when the breaker is in use, the reaction means being so mounted that a portion of the breaker plate may be displaced over the conveyor to an extent determined by the lump breaking gap required.

6. A breaker according to claim 1, wherein power means are provided for effecting any adjustment of the reaction means with respect to the breaker element periphery.

7. A breaker according to claim 6, wherein the power means comprises a hydraulic piston and cylinder unit mounted in said framework and operable on the reaction means via a lever pinned to the said framework.

8. A breaker according to claim 7, wherein the lever is arranged to act on the reaction means via a roller.

9. A breaker according to claim 7, wherein the hydraulic circuit associated with the hydraulic piston and cylinder unit preferably includes a relief valve to release the reaction means to open to the maximum extent the gap between the breaker element periphery and the reaction means, should material be encountered that the breaker is not capable of breaking.

10. A breaker according to claim 1, wherein the said framework is generally of inverted U-shape, of a span to bridge a standard width pan of an armoured conveyor.

11. A breaker according to claim 3, wherein the framework is recessed so that (when the lump breaker is positioned for use with a conveyor) by releasing the securement of the gearbox and fluid coupling casing from the framework, the casing, together with the suspended breaker element, may be swung away from the conveyor.

12. A breaker according to claim 1, wherein means are provided to permit the breaker element to be adjustable in height with respect to the conveyor.

13. A breaker according to claim 3, wherein means for permitting the breaker element to be adjustable in height with respect to the conveyor are provided which include or consist of removable packing elements between the casing of the gearbox and fluid coupling and the framework.

14. A breaker according to claim 1, wherein the breaker element comprises a breaker drum.

15. A breaker according to claim 3, wherein means are provided to permit the breaker element, which is in the form of a drum, to be adjustable in height with respect to the conveyor, and wherein the height adjustment means include or consist of removable sections of the said drum.

16. A breaker according to claim 14, wherein the drum is provided with peripheral static mineral breaking picks.

17. A breaker according to claim 14, wherein picks are provided on swinging hammers pivotable about axes parallel to that of drum rotation.

18. A breaker according to claim 14, wherein the drum is built up from a plurality of axially spaced wafer plates, with common pivot pins passing through aligned holes in the plates, with the hammers located between pairs of adjacent plates.

19. A breaker according to claim 1, wherein the reaction means comprises a breaker plate.

20. A breaker according to claim 1, wherein the reaction means comprises an assembly of reaction discs rotatably mounted about an upright or substantially upright (as defined above) common axis.

* * * * *